United States Patent [19]

Bogucki-Land

[11] Patent Number: 4,528,631

[45] Date of Patent: Jul. 9, 1985

[54] PROCESS FOR THE CONTROL OF WARPING SPEED AND A DIRECT WARPING MACHINE FOR CARRYING OUT THIS PROCESS

[75] Inventor: Bogdan Bogucki-Land, Offenbach, Fed. Rep. of Germany

[73] Assignee: Karl Mayer Testilmaschinenfabrik GmbH, Obertshausen, Fed. Rep. of Germany

[21] Appl. No.: 427,123

[22] Filed: Sep. 29, 1982

[30] Foreign Application Priority Data

May 21, 1982 [DE] Fed. Rep. of Germany ..... 3219132

[51] Int. Cl.[3] ..... G06F 15/46

[52] U.S. Cl. ..... 364/470; 28/185; 28/190; 66/205

[58] Field of Search ..... 364/470; 28/185, 190, 28/204; 66/205, 212, 210

[56] References Cited

U.S. PATENT DOCUMENTS 3,858,415 1/1975 Wilson et al. ..... 364/470
3,961,500 6/1976 Braley et al. ..... 66/210
3,989,068 11/1976 Kakinaka ..... 364/470
4,426,856 1/1984 Winter et al. ..... 66/212

FOREIGN PATENT DOCUMENTS 2917666 11/1980 Fed. Rep. of Germany ..... 28/185
2939312 4/1981 Fed. Rep. of Germany ..... 66/212

*Primary Examiner*—Jerry Smith
*Assistant Examiner*—Louis Woo
*Attorney, Agent, or Firm*—Omri M. Behr

[57] ABSTRACT

In the process for the control of the warp speed during direct warping, the winding diameter is determined by a contactless measurement. The actual thread speed is determined from the winding diameter and the current warp beam rate of rotation. A direct warping machine for carrying out this process has a transducer for measuring the winding diameter. This transducer is located proximate to but not in contact with the circumference of the winding for measuring the winding diameter. Also included is an arrangement for the determination of the rate of rotation of the warp beam. Also, a computer can calculate the thread speed from the above outputs that correspond to winding diameter and rate of rotation.

12 Claims, 1 Drawing Figure

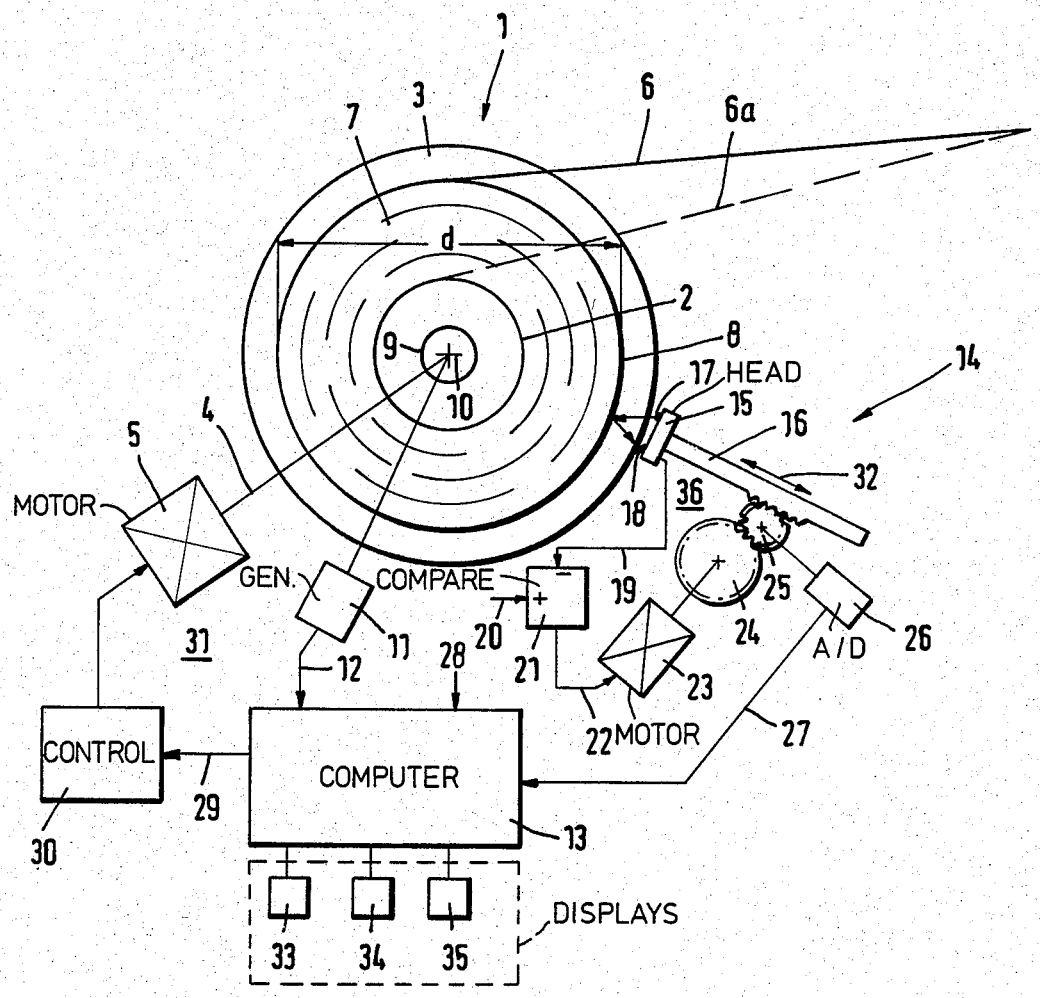
1
3
6
6a
7
d
2
8
9
10
17
HEAD
15
14
16
32
36
18
5
4
MOTOR
GEN.
COMPARE
19
25
20
21
24
A/D
26
31
11
12
28
23
22
MOTOR
27
CONTROL
COMPUTER
29
30
13
DISPLAYS
33
34
35

PROCESS FOR THE CONTROL OF WARPING SPEED AND A DIRECT WARPING MACHINE FOR CARRYING OUT THIS PROCESS

BACKGROUND OF THE INVENTION

1. Field of the Invention

The present invention relates to apparatus and a process for the control of the warping speed in direct warping, in which: the actual value of the thread speed is determined and compared with the desired value; and, in dependence upon the control deviation, the driven speed of the warp beam is decreased with increasing winding diameter.

2. Discussion of the Relevant Art

As is disclosed in the reprint from "Kettenwirkpraxis", issue 3/81 published by applicant's assignee, it is known to provide a roller in front of the warp beam around which the warp thread is turned. This roller is provided with a tachometer and its output potential is utilized as a measure of the actual value of the thread speed. In this manner, the warping speed can be determined with an accuracy with ±1%. However, since such a roller is driven by frictional forces, a rather substantial burden is placed on the warp thread. Furthermore, during the start-up and braking stages, the control arrangement is influenced by slippage which occurs between the roller and the warp thread.

Accordingly there is a need for an improved apparatus and process of the foregoing type for providing better control of the warp speed without mechanically influencing the warp thread.

SUMMARY OF THE INVENTION

An arrangement according to the principles of the present invention can control the warping speed of a directly warped warp beam rotating at a known angular speed by regulating, toward a predetermined projected value, the linear speed of transfer of thread windings with respect to said beam. The arrangement has a transducer means for providing in a contactless manner a diameter signal signifying the wound diameter of the warp beam. The arrangement also has a control means and a comparison means. The comparison means is coupled to the transducer means for providing an adjust signal as a predetermined function of the diameter signal and the known angular speed. The control means is coupled to the comparison means for controlling the rate of rotation of the warp beam in response to the adjust signal. The comparison means is operable to vary the adjust signal to reduce the rate of rotation of the warp beam in response to a change in the diameter signal indicating an increase in the wound diameter of the warp beam.

According to a related method of the same invention the warping speed of a directly warped warp beam can be controlled. The method includes the step of measuring the wound diameter of the warp beam in a contactless manner. Another step is comparing against a predetermined projected valve a calculated linear thread speed value. The thread speed value is obtained as a predetermined function of the angular speed and wound diameter of the warp beam. The method also includes the step of controlling the warp beam to keep its rate of rotation inversely proportional to its wound diameter.

The foregoing provides that the winding diameter is measured by contactless testing and the actual value of the thread speed is calculated from the diameter of the wind and the current, actual rate of rotation of the warp beam.

In this procedure the thread speed is not measured directly, but rather is calculated. For this reason, it is possible to work with values, namely the winding diameter and the warp beam rate of rotation, which can be determined without contact with the thread warp. Thus, there is avoided any mechanical burden upon the warp thread caused by or connected with the measuring step. The measuring result can also not be influenced by slippage during start-up or braking. The procedure is also highly suitable for very high thread speeds, for example rates of between 800 to 1200 meters per minute.

A preferred direct warping machine for carrying out the process comprises a warp beam drive motor whose rate of rotation is controllable in dependence upon a comparison between the actual and desired value of the thread speed. A diameter measuring arrangement cooperating with the winding circumference but not in contact therewith provides one datum. Another datum, the warp beam rotational speed, is determined by a sensor. A computer can calculate the thread speed from the outputs of the two previously mentioned arrangements. When the calculating arrangement is able to provide the actual value of the thread speed, only the factor $\pi$ remains necessary for the calculation. There is also the possibility of providing output values from which the winding diameter or the rate of rotation is first calculated in the calculating arrangement.

BRIEF DESCRIPTION OF THE DRAWING

In order that the invention may be more fully understood, it will now be described, by way of example, with reference to the accompanying drawing which is a schematic diagram more fully described hereinafter.

DESCRIPTION OF THE PREFERRED EMBODIMENT

Warp beam 1, which includes therein a partial warp beam, comprises a beam cylinder 2 and two coaxial side-flanges 3. Drive axle 4 is concentrically connected with beam cylinder 2 and is driven by a motor 5 whose rate of rotation may be controlled; for example, a DC shunt wound motor. A thread warp 6 which is provided from a spool creel (not shown) runs, during the warping, through the usual (and unillustrated) arrangements and is then wound onto warp beam 1, resulting in the formation of a thread wind 7 having a winding circumference 8. This winding has, at a given time point, a diameter d which increases constantly relative to the diameter of the beam cylinder 2. As the diameter 8 increases the thread warp alters its position from position 6*a* indicated in phantom to the full line, illustrated position 6. It will be appreciated that for unwinding, the thread will move from position 6 to 6*a*. A disc 9 mounted coaxially on one end of axle 4 has markings 10. These markings are read by pulse generator 11 (acting as a speed means) so that four pulses are provided along output line 12 per revolution, to digital computing means 13. Of course a different pulse rate can be employed in different embodiments. The pulse rate indicates the rate of rotation n of warp beam 1. Computer 13 can be in the form of a microcomputer having programmed steps for performing the functions hereinafter described. Other forms are possible for computer 13 including analog computers, analog feedback systems, minicomputers or larger, general purpose computers, depending upon the desired speed, accuracy, memory capacity etc. Computer 13 and generator 11 are referred to herein as a comparison means.

A transducer means, shown herein as diameter measuring arrangement 14 comprises a measuring head 15 on a toothed rack 16. Measuring head 15 has fixedly mounted on it an optical transmitter 17 and an optical receiver 18 which are oriented at such angles to each other that at a predetermined distance from the circumference of winding 8 they are coupled by a beam path reflected by this circumferential surface. Transmitter 17 can include a monochromatic source in the visible or infrared spectrum focused into a narrow, collimated beam. Receiver 18 can have a pin-hole aperture covering a photodetector so that only radiation arriving at a predetermined angle of incidence is detected. While the above contactless testing is carried out optically, that is to say by means of a light beam, a capacitive detector can be used instead. This capacitative detector can be placed near winding 8 which then acts as a dimensionally variable dielectric.

In any event receiver 18 produces a predetermined output when the optical axes of elements 17 and 18 intersect at the surface 8 of the winding. The output signal of receiver 18 is led via line 19 to a comparator 21 having a comparison value input 20. The discrepency between inputs 19 and 20 affects output 22 and controls control motor 23 which displaces the toothed rack 16 via two meshed gears 24 and 25. Preferably, measuring head 15 of diameter measuring arrangement 14 is adjusted radially to the warp beam by control motor 23 and control circuit 21 to maintain measuring head 15 at a constant distance from winding circumference 8. The positioning caused by this control loop serves as a measure of the winding diameter. Since measuring head 15 accurately follows the winding diameter and the controlled position can be readily determined, there may thus be provided a very simple means of determining the winding diameter. Since optical sender 17 and receiver 18 of head 15 are angled with respect to each other in such a manner that at a predetermined distance from the winding diameter, they are coupled by a light beam reflected by the circumference of the wind, an increase of the winding diameter, reduces the predetermined separation so that the coupling factor is altered. This change gives rise to the corresponding readjustment of measuring arrangement 14. In this manner control circuit 36 ensures that measuring head 15 retains a predetermined separation from the winding circumference 8.

Control motor 23 can be a stepping motor which is regulated by pulses led over line 22. A converter 26 driven by tooth wheel 25 converts the regulated distance traveled by the toothed rack 16 (received as an angular displacement) into a coded electrical signal which is provided to calculator 13 via lead 27. Converter 26 can be a shaft encoder producing a binary coded decimal or Grey code. In addition, calculator 13 has a further input 28 through which the desired projected value of thread speed is inserted. If the output 29 shows a control discrepancy, a control means 30 for drive motor 5 is activated. There is thus produced a control circuit 31 for maintaining the desired linear thread speed. The desired value is generally determined by the warp characteristics.

At the beginning of the warping, the measuring head 15, by action of the control motor 23, is run radially towards the center of beam 1 so that a predetermined separation from the diameter 8 of the beam is provided. During the warping, diameter d of the wind 7 increases. The diameter d at any given moment may be calculated by computer 13 from the starting diameter and the change in the regulating distance 32. Additionally, the calculator determines the present angular rate of rotation n from pulses provided through lead 12. For example, computer 13 may cooperate with an internal clock that establishes a base interval. The number of pulse occurring during the base interval is therefore proportional to the angular speed of beam 1. From this angular speed value, computer 13 then calculates the actual value V of the linear thread speed in accordance with the formula:

$$V = n\pi d$$

This actual value V is compared to the desired value of thread speed stored in computer 13 and correspondingly a signal is given over lead 29 in order to correct the rate of rotation of motor 5 if there is a regulatory discrepancy.

It is particularly advantageous that computer 13 has desired value input 28 and output 29 for the control deviation since computer 13 can simultaneously take over the comparison of actual and projected values so that the actual values need in fact never be directly known by the operator.

Computer 13 can be provided with an indicating arrangement 33 in which the thread speed V can be displayed. This display can employ a seven segment numeric display. Yet another indicating arrangement 34 may be provided to indicate the wound-up length L of the threads on the wind 7 which may be calculated in accordance with the formula:

$$L = \Sigma \pi d_m$$

This formula indicates the current circumference is summed at each revolution. Yet a further third indicator 35 may be provided to indicate the absolute number of rotations of the warp beam which can be calculated from the signals provided by pulse generator 11.

It is advantageous to utilize a digital computer as the calculating arrangement and to provide the diameter measuring arrangement as well as the arrangement giving warp beam rate of rotation with a means for the digitalization of the output values. Such digital computers work very accurately and take up very little space. In particular, the diameter measuring arrangement can comprise an analog/digital converter to convert the setting value into electrical binary values, in particular in Grey code or BCD code. The digitalization of the warp beam rate of rotation is very readily obtained in that the circumference is provided with markings for activating a pulse generator which provides a predetermined number of pulses per revolution.

It will be understood that various changes in the details, materials, arrangement of parts and operating conditions, which have been herein described and illustrated in order to explain the nature of the invention, may be made by those skilled in the art within the principles and scope of instant invention.

What is claimed is:

1. An arrangement for controlling the warping speed of a directly warped warp beam rotating at a known angular speed by regulating, toward a predetermined projected value, the linear speed of transfer of thread windings with respect to said beam, comprising:

transducer means mounted adjacent said warp beam for measuring its diameter without touching it and for providing a diameter signal signifying the wound diameter of said warp beam;

comparison means coupled to said transducer means for providing a command signal as a predetermined function of said diameter signal and said known angular speed, said comparison means including means for storing a velocity value equivalent to said known angular speed and for calculating and varying said command signal in response to said velocity value and said diameter signal according to said predetermined function; and control means coupled to said comparison means for controlling the rate of rotation of said warp beam in response to said command signal, said comparison means being operable to vary said command signal to reduce the rate of rotation of said beam in response to a change in said diameter signal indicating an increase in the wound diameter of said warp beam, said transducer means comprising:

a measuring head mounted alongside said warp beam for moving at least radially with respect thereto and for providing a head signal related to the spacing between said head and windings on said beam;

an adjuster for radially moving said measuring head; and a control circuit coupled to said adjuster and measuring head for operating the former to maintain the latter at a predetermined distance from windings on said warp beam in response to said head signal, said diameter signal bearing a predetermined relationship to the positioning caused by said control circuit through said adjuster.

2. An arrangement according to claim 1 wherein said transducer means comprises:

an optical sensor positioned alongside said warp beam, said optical sensor being spaced from and facing the windings on said warp beam.

3. An arrangement according to claim 1 wherein said transducer means comprises:

a capacitive device positioned alongside said warp beam and having a capacitance that varies with the spacing between said capacitive device and windings on said warp beam, said capacitive device being spaced from and facing the windings on said warp beam.

4. An arrangement according to claim 1 wherein said control means has a variable speed motor having a speed terminal coupled to said comparison means to receive said command signal and vary the speed of said motor in response to said command signal, said motor being coupled to said warp beam for driving it, said comparison means comprising:

speed means coupled to said warp beam for providing a speed signal signifying the present angular rate of rotation of said warp beam; and computing means coupled to said speed means and said transducer means for calculating a linear thread speed value related to the product of the wound diameter of said warp beam and its angular speed and derived from said diameter and speed signal, said command signal being varied as a given function of the discrepancy between said predetermined projected value and said linear thread speed value, said transducer means being spaced from said warp beam.

5. An arrangement according to claim 4 wherein said computing means comprises:

(a) a projection input terminal for receiving signals for setting the magnitude of said predetermined projected value; and (b) an output terminal coupled to said control means and carrying said command signal.

6. An arrangement according to claim 1 wherein said measuring head comprises:

an optical transmitter for transmitting light toward windings on said warp beam; and an optical receiver for receiving reflections from windings on said warp beam, said transmitter and receiver being relatively angled to allow optical coupling when both are at predetermined spacings from winding on said warp beam.

7. An arrangement according to claim 6 wherein said computing means comprises:

a digital computer, said diameter signal and speed signal both being digital.

8. An arrangement according to claim 7 wherein said transducer means further comprises:

an analog to digital converter.

9. An arrangement according to claim 8 wherein said speed means includes:

a pulse generator coupled to said warp beam for producing a pulse in response to predetermined increments of rotation of said warp beam.

10. A method for controlling the warping speed of a directly warped warp beam with a measuring head providing a distance-related, head signal, comprising the steps of: (a) measuring the wound diameter of said warp beam in a contactless manner by: (i) moving said head at least radially with respect to said warp beam until said head signal reaches a predetermined value, said value signifying a spacing of said head from said beam of a predetermined distance; and (ii) measuring the radial spacing of said head from the axis of said warp beam and subtracting therefrom said predetermined distance to derive the wound diameter of said warp beam; (b) comparing against a predetermined projected value a calculated linear thread speed value obtained as a predetermined function of the angular speed and wound diameter of said warp beam; and (c) controlling said warp beam to keep its rate of rotation inversely proportional to its wound diameter.

11. A method according to claim 10 wherein the step of measuring the wound diameter of said warp beam is performed optically.

12. A method according to claim 10 wherein the step of measuring the wound diameter of said warp beam is performed with a capacitive device whose capacitance changes as the wound diameter of said warp beam changes.

* * * * *